US005103560A

United States Patent [19]

Podolsky

[11] Patent Number: 5,103,560

[45] Date of Patent: Apr. 14, 1992

[54] SHAVING DEVICE WITH DISPENSER

[76] Inventor: Grigory Podolsky, 35-53 82 St., #3H, Jackson Height, N.Y. 11372

[21] Appl. No.: 531,081

[22] Filed: May 31, 1990

[51] Int. Cl.[5] ..... B26B 19/28

[52] U.S. Cl. ..... 30/41; 30/86

[58] Field of Search ..... 30/41, 86, 32, 34.05

[56] References Cited

U.S. PATENT DOCUMENTS 1,892,836 1/1933 Harvey ..... 30/41

*Primary Examiner*—Douglas D. Watts

*Attorney, Agent, or Firm*—E. Zborovsky

[57] ABSTRACT

The shaving device has a hollow handle accommodating the shaving cream, a head, a supply element for supplying the shaving cream from the inner chamber of the hollow handle through the head onto the user's skin, a brush for distributing the shaving cream on the user's skin, and a shaving element for shaving the user's hair after the application of the shaving cream.

11 Claims, 3 Drawing Sheets 1
2
3
4
5
6
7
8
43
44
45
46
47
48
49
50
51
52
53
54
55
56

25
22

41
42

32
33
38

15
15

34

8
8
9
9
12
12
10
10
26

25

11
10

SHAVING DEVICE WITH DISPENSER

BACKGROUND OF THE INVENTION

The present invention relates to shaving devices.

Shaving devices of different types are known in the art. Usually, during the use of a shaving device with razor blades, first the user applies a shaving cream on the skin and distribute it over the skin and then the shaving device with the razor is used to shave the hair. The known shaving devices possess several disadvantages. First of all, they are not used for applying and distributing the shaving cream on the skin. It is necessary to apply to distribute the shaving cream on the skin by an additional device or by hand which is inconvenient and unpleasant. The known shaving devices with razor blades do not massage the user's skin during shaving. These and other disadvantages make desirable to improve the construction of existing shaving devices.

SUMMARY OF THE INVENTION

Accordingly, it is an object of the present invention to provide a new and improved shaving device, which avoids the disadvantages of the prior art.

In keeping with these objects and with others which will become apparent hereinafter, one feature of the present invention resides, briefly stated, in a shaving device which has a hollow handle with an inner chamber, a head, means for supplying the shaving cream from the inner chamber of the handle through the head onto the user's skin, bruch means for distributing the shaving cream on the user's skin, and shaving means for shaving the user's hair.

When the shaving device is designed in accordance with the present invention, it simultaneously applies and distributes the shaving cream and shaves the hair on the user's skin. When the shaving device is provided with additional massaging means, it also massages the skin which further improves the quality of the shaving. The inventive device is easy to wash, much more convenient to sue since it simultaneously performs several operations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3, 4, 32, 33:
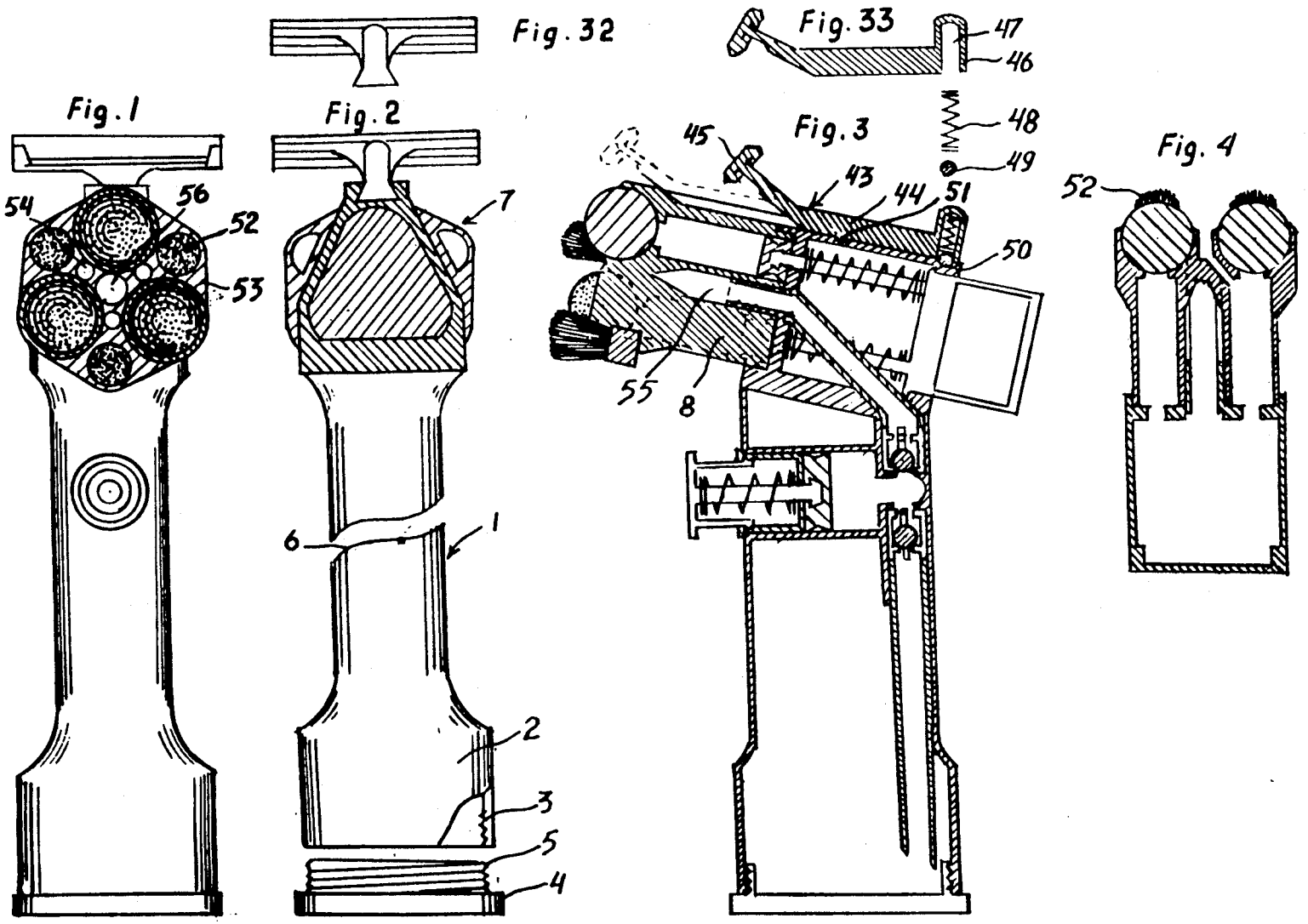
FIG. 1 shows a front view of the device in accordance with the present invention.
FIG. 2 is a view showing a rear of the device in accordance with the present invention.
FIG. 3 is a side view of the device in accordance with the present invention.
FIG. 4 is a partial view from below of the inventive device without a handle.
FIGS. 32 and 33 are a rear view and a side view of a shaving element.
Figure 17:
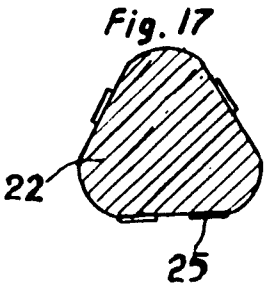
FIG. 17 is a rear view of the push button.
Figure 11:
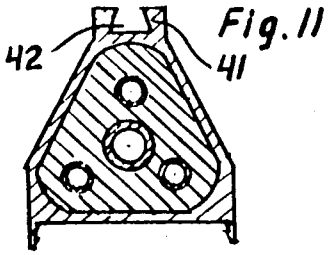
FIG. 11 is a rear view of the inventive head.
Figure 18:
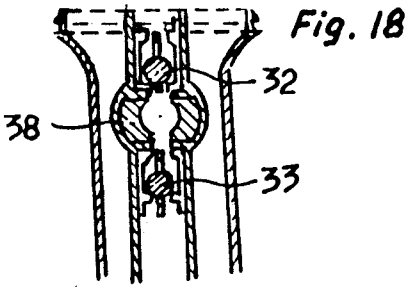
FIG. 18 is a rear view of the handle with a pump.
Figure 10:
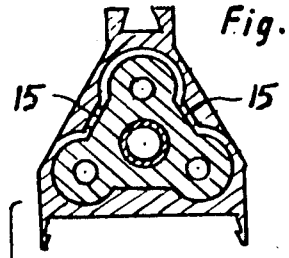
FIG. 10 is a front view of the head with the handle of the inventive device.
Figure 8:
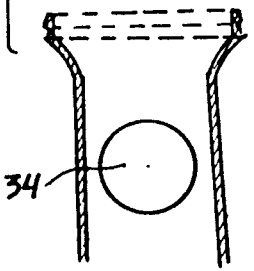
FIG. 8 is a view from below of the head with a central unit and a push button.
Figure 8:
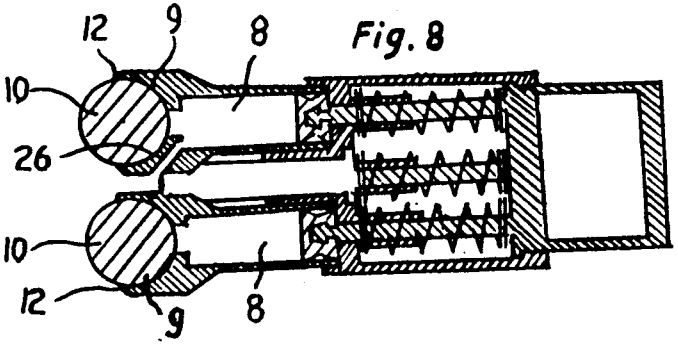
Figure 5:
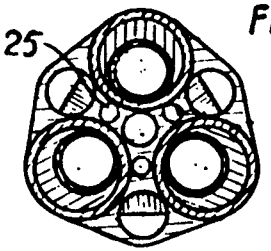
FIG. 5 is a front view of a head of the inventive device.
Figure 6:
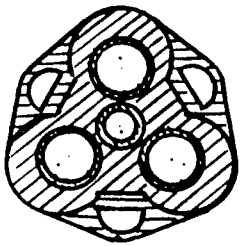
FIG. 6 is a rear view of the head of FIG. 5.
Figure 9:
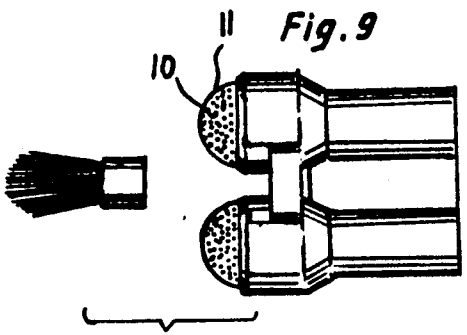
FIG. 9 is a view from below of the head with a brush attachable to the head.
Figures 7, 12, 13, 14, 15, 16, 19, 20, 21, 22, 23, 24, 25, 26, 27, 28, 29, 30, 31:
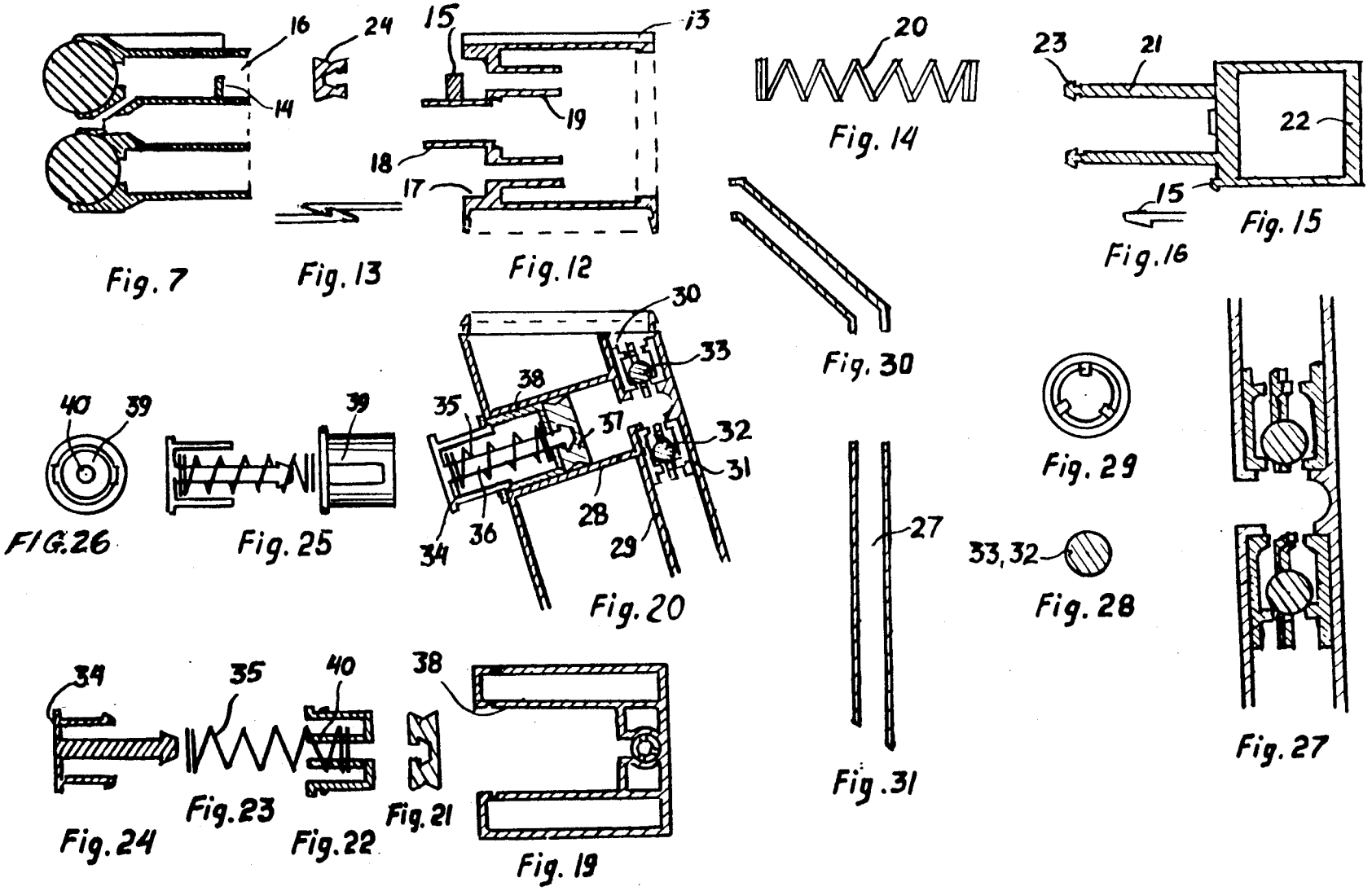
FIG. 7 is a side view of the head of the inventive device.
FIG. 12 is a side view of the central unit.
FIG. 13 is a side view of the inventive head associated with the central unit.
FIG. 14 is a view showing a spring for assembling the device.
FIG. 15 is a side view of the push button associated with the spring of the central unit.
FIG. 16 is a view showing one of the fixing elements for fixing the push button in the central unit.
FIG. 19 is a top view of the handle with a pump for supplying shaving cream.
FIG. 20 is a view showing a piston of the pump for the shaving cream.
FIG. 21 is a bush for the pump.
FIG. 22 is a spring for the shaving cream pump.
FIG. 23 is a spring for assembly.
FIG. 24 is a push button for the shaving cream pump.
FIG. 25 shows the push button of FIG. 24 together with the bush of FIG. 20.
FIG. 26 is an end view of the push button shown in FIG. 24.
FIG. 27 is a view showing the pump for shaving cream on an enlarged scale.
FIG. 28 shows a ball to be inserted in the pump.
FIG. 29 is a view showing a bush for the pump of FIG. 27.
FIG. 30 is a view showing a pipe for connecting the shaving cream pump with the central unit and then with the head.
FIG. 31 is a view showing a lower pipe extending from the shaving cream pump to the shaving cream reservoir in the handle.

As can be seen from FIGS. 1 and 2, the device in accordance with the present invention has a handle which is identified as a whole with reference numeral 1. The handle has an inner hollow with a wider part 2 provided with a thread 3 closeable by a plug 4 provided with a further thread 5. The handle 1 also has a narrow part 6 of an oval cross-section.

A head 7 is mounted on the handle 1. The head has longitudinal passages 8 with outlet openings 9 which are offset radially from the axes of the passages 8. Balls 10 are retained in the recesses 9 and provided with a plurality of very small depressions 11. The balls 10 are retained in the recesses 9 by shoulders 12 projecting slightly beyond the maximum radius of the balls forwardly.

A central unit 13 is connectable with the head 7 by interengagement of a projection 14 provided in the head with the projections 15 provided in the central unit. Cylinders 16 in which the passages 8 are formed engage in a recess 17 provided at the front end of the central unit 13. A bush 18 projecting forwardly from the center unit 13 engages between the cylinders 16. Bushes 19 are located in the interior of the central unit 13 and can carry springs 20 in the assembled condition. Projections 21 of a push button 22 extend into the interior of the bushes 19 and have arresting formations 23 which are arrested pistons 24 movable in the passages 8. Arresting formations 25 fix the button 22 in the interior of the central unit 13. The elements 16, 24, 20, 23, 21 and 22 form together a pump for sucking water preferably warm water into the passages 8 and then expelling warm water from the passages 8 toward the balls 10. Openings 25 provided on the front surface of the head serve for passing the water therethrough into the passages 8 and from the passages 8. The openings 25 communicate by connecting passages 26 with the passages 8.

A pump for supplying a shaving cream 2 to the central area of the head between the balls 10 includes an inlet pipe 27, a housing 28 located in the handle and having cylinder portions 29, 30 and 31, valve members 32 and 33 located in the cylinders 29 and 30, a push button 34 provided with a spring 35 and a rod 36 which is connected with a piston 37 movable in the cylinder 38. A bush 39 is located rearwardly of the piston 37 and has a central opening 40 through which the projections 36 extend to engage the piston 37.

The head 7 is provided with a guide 41 formed for example with a dove-tail shaped groove 42. A shaving element 43 is movable in the groove 42. The shaving element includes a holder 44 with a front end on which a shaving cartridge 45 is fittable. The shaving element has a rear part 46 provided with a passage 47 for receiving a spring 48 and a ball 49. The bottom wall of the groove 42 is provided with two depressions 50 and 51. The shaving element 43 can move along the groove 42 and be fixed in its rear position shown in FIG. 3 in a solid line or a front position shown in a broken line.

Brushes 52 are insertable in recesses 53 formed at the sides of the head 7. The brushes 52 project forwardly somewhat beyond the front surface of the balls 10.

The head has openings 54 for supply water into the cylinders 8. The head also has a central passage 55 communicating with an outlet opening 56 for supplying the shaving cream.

The device operates in the following manner:

First of all, the button 22 is pushed forwardly toward the front end of the head or toward the balls 10 so that the pistons 24 are brought actually in contact with the rear surface of the ball 10. Then the head is immersed into a warm water and the button 22 is released. Under the action of the spring the button is moved to the right in an opposite direction and pulls the pistons 24 away from the balls so that the warm water is aspirated into the passages 8 through the openings 54. Then the push button 34 is pushed inwardly and released several times so that it moves back under the action of the spring. During the rearward movement of the piston 37 the shaving cream is aspirated through the pipe 27 from the inner hollow of the handle into a chamber formed between the balls 32 and 33. During subsequent push of the button 34 inwardly, the dose of the shaving cream is pressed through the cylinder 30 into the pipe 30' and then exits through the tubular element 18 through the central opening 56. When the head is applied on the skin of the user, the paste is expelled on the skin and the head is moved along the skin, the shaving cream is applied to the skin, the balls then rotate and entrain a thin film of water from the passages 8 so as to apply it on the layer of the shaving cream on the skin, and the brushes 53 uniformly distribute the shaving cream and water and make a foam on the skin. When the skin of the user is covered with the foam the shaving element 43 is moved from its rear position to its front position, and the user shaves the hair on the skin by the razor 45 of the shaving element 43. It is however possible to apply the shaving cream on the skin without supplying additional water.

The invention is not limited to the details shown since various modifications and structural changes are possible without departing in any way from the spirit of the present invention.

What is claimed and desired to be protected with Letters Patent is set forth in particular in the appended claims:

1. A shaving device, comprising, a handle having an inner chamber for accommodating a shaving cream; a head connected with said handle and having passage means for passing shaving cream supplied form said inner chamber of said handle through said head and outwardly of the latter; means for supplying the shaving cream from said handle to said head and outwardly of the latter; brush means provided on said head for distributing the shaving cream discharged from said head over the skin of the user; shaving means provided on said head for shaving after the application of the shaving cream on the skin of the user; and means for aspirating water into said head and then expelling the water from said head outwardly on the user'skin.

2. A shaving device, comprising, a handle having an inner chamber for accommodating a shaving cream; a head connected with said handle and having passage means for passing shaving cream supplied form said inner chamber of said handle through said head and outwardly of the latter; means for supplying the shaving cream from said handle to said head and outwardly of the latter; brush means provided on said head for distributing the shaving cream discharged from said head over the skin of the user; and shaving means provided on said head for shaving after the application of the shaving cream on the skin of the user, said supplying means including pump means provided in said handle and a shaving cream passage communicating said pump means with said head and extending through said head said means for supplying shaving cream also including a spring-biased push button arranged to activate said pump means so as to aspirate the shaving cream from said inner chamber of said handle and supply the shaving cream to said passage means.

3. A shaving device, comprising, a handle having an inner chamber for accommodating a shaving cream; a head connected with said handle and having passage means for passing shaving cream supplied from said inner chamber of said handle through said head and outwardly of the latter; means for supplying the shaving cream from said handle to said head and outwardly of the latter; brush means provided on said head for distributing the shaving cream discharged from said head over the skin of the user; shaving means provided on said head for shaving after the application of the shaving cream on the skin of the user; and means for massaging the user's skin and including at least one rotatable body arranged in said head and bringable into contact with the user's skin.

4. A shaving device as defined in claim 1, wherein said supplying means includes pump means provided in said handle and a shaving cream passage communicating said pump means with said head and extending through said head.

5. A shaving device as defined in claim 1, wherein said means for aspirating and expelling water includes passage means extending through said handle and opening outwardly and water pump means arranged to aspirate water from outside into said water passage means and expel the aspirated water through said water passage means outwardly of said head.

6. A shaving device as defined in claim 2: and further comprising means for massaging the user's skin and including at least one rotatable body bringable into contact with the user's skin, said rotatable body being located in said water passage means so that it simultaneously applies water on the skin and massages the user's skin.

7. A shaving device as defined in claim 6, wherein said rotatable body is provided with a plurality of cavities formed to temporarily retain the water.

8. A shaving device as defined in claim 1,, wherein said head has a front face provided with at least one first opening for aspirating water into said head and expelling the water from said head outwardly onto the user's skin, at least one second opening for expelling the shaving cream from said head unto the user's skin, at least one brush means for distributing the shaving cream on the user's skin, at least one rotatable body for massaging the user's skin.

9. A shaving device as defined in claim 8, wherein said front face of said head has an additional opening for rotatably retaining said rotary body, and a peripheral laterally open cavity for accommodating said brush means.

10. A shaving device as defined in claim 1, wherein said shaving means is turnable between a first retracted position in which it is retracted rearwardly of said head so that the shaving cream can be first applied on the user's skin and said brush means can distribute the shaving cream on the user's skin, and a second position forwardly of said head for shaving the user's hair.

11. A shaving device as defined in claim 10; and further comprising means for fixing said shaving means in each of said positions.

* * * * *